United States Patent [19]

Keir et al.

[11] Patent Number: 4,508,260

[45] Date of Patent: Apr. 2, 1985

[54] PORTABLE CONTAINER FOR VALUABLE ARTICLES

[75] Inventors: Grant G. H. Keir; John A. Peebles; Jonas K. McNab; Ian N. Campbell, all of Dundee, Scotland

[73] Assignee: NCR Corporation, Dayton, Ohio

[21] Appl. No.: 509,488

[22] Filed: Jun. 30, 1983

[30] Foreign Application Priority Data

Feb. 3, 1983 [GB] United Kingdom ..... 8302932

[51] Int. Cl.[3] ..... G08B 13/08; E05B 39/04

[52] U.S. Cl. ..... 232/43.1; 109/38; 109/39; 70/436

[58] Field of Search ..... 70/433, 436; 109/38, 109/39, 44, 43, 50, 52; 232/43.1

[56] References Cited

U.S. PATENT DOCUMENTS

| | | | |
|---|---|---|---|
| 499,505 | 6/1893 | Beasley | 70/436 |
| 506,647 | 10/1893 | Littell | 70/436 |
| 564,185 | 7/1896 | Dates | 70/436 |
| 583,101 | 5/1897 | Tuttle | 70/436 |
| 585,016 | 6/1897 | Aldrich | 70/436 |
| 2,222,434 | 11/1940 | Hofmann | 70/436 |
| 3,276,835 | 10/1966 | Hall | 312/333 |
| 3,854,655 | 12/1974 | Armstrong | 232/4 R |
| 4,131,001 | 12/1978 | Gotto | 70/14 |
| 4,186,977 | 2/1980 | Gilovich et al. | 109/52 |
| 4,253,016 | 2/1981 | Hirose | 235/381 |
| 4,275,667 | 6/1981 | Hilton | 109/44 |
| 4,337,393 | 6/1982 | Hilton | 235/487 |

FOREIGN PATENT DOCUMENTS

| | | | |
|---|---|---|---|
| 10598 | 5/1980 | European Pat. Off. . | |
| 66324 | 12/1982 | European Pat. Off. | 109/52 |
| 593280 | 3/1959 | Italy | 70/436 |
| 998148 | 7/1965 | United Kingdom . | |
| 2039264A | 6/1980 | United Kingdom . | |
| 201146 | 8/1967 | U.S.S.R. | 70/433 |

OTHER PUBLICATIONS

Examiner's Report from Corresponding U.K. application No. 8302932.

*Primary Examiner*—John J. Wilson
*Assistant Examiner*—John G. Weiss
*Attorney, Agent, or Firm*—Albert L. Sessler, Jr.; Elmer Wargo

[57] ABSTRACT

A portable depository container 10 for an automated teller machine (ATM) articles as, for example, magnetic credit cards captured by the ATM. With the container dismounted from the ATM, an entry slot 16 is locked against passage of articles therethrough by means of a bar 22. Upon the container being mounted in a receiving cradle 18 of the ATM, the bar 22 is moved to an unlocked position by means of key pins 168, 170 which engage and move rearwardly with a pair of slide members 42, 44. This movement of the member 42 brings about a rotational movement of a resettable indicator wheel 76 which carries a series of markings on its perimeter. The particular marking of the wheel 76 visible through an indicator window provides an indication of the number of times the bar 22 has been unlocked since resetting of the wheel, and can thereby indicate whether tampering with the container has taken place. A second embodiment for handling articles such as currency in envelopes utilizes a resettable indicator slide 208.

15 Claims, 11 Drawing Figures

PORTABLE CONTAINER FOR VALUABLE ARTICLES

BACKGROUND OF THE INVENTION

The invention relates to a portable container for valuable articles such as credit cards or envelopes containing currency, for example.

The invention has application, for example, to a portable depository container for use with automated teller machines (ATMs) of the kind wherein a user inserts a customer identifying card into the machine and then enters certain data (such as codes, amount of cash required or to be paid in, type of transaction, etc.) upon a keyboard, and deposits in the machine any currency notes to be paid in. The machine will then process the transaction, update the user's account to reflect the current transaction, dispense cash if necessary, and return the card to the user and issue a transaction record slip as part of a routine operation. The container may serve as a collecting receptacle for customer identifying cards (for example invalid cards) captured by an ATM or for envelopes containing cash deposited in an ATM, and may be used for transporting collected cards or envelopes to a bank at a location remote from the ATM in which the container was used.

One known portable depository container, such as that disclosed in European patent application having Publication No. 0010598, is provided with a lock for locking the container in a closed condition and for unlocking the container to enable it to be opened to permit valuable articles such as currency notes to be deposited in the container. The container is arranged to be placed while in a locked condition in a secure housing, and to be unlocked and filled with currency notes within the housing while the container is secured against removal therefrom by means of mechanical interlocks. However, such known depository container has a disadvantage from a security point of view in that the lock can be opened in an illegal or unauthorized manner while the container is outside the secure housing, and there is no means of knowing whether such illegal or unauthorized opening of the container has taken place.

Another known portable container for valuable articles incorporates tamper indicating means for indicating whether an unauthorized unlocking of the container has taken place. Such known container is adapted to be inserted into an ATM, and is arranged to be unlocked while inserted or while in the process of being inserted. After the container has been unlocked once, the tamper indicating means prevents reinsertion of the container into the ATM without the container having first been removed to a secure or authorized location for opening of the container and for resetting of the tamper indicating means. A problem experienced with such known container is that the tamper indicating means may be prematurely activated due to a fumbled insertion of the container in the ATM or due to the need for removal of the container to permit servicing of the ATM, such premature activation possibly resulting in the ATM being taken out of service until a container having a reset tamper indicating means is obtained for insertion into the ATM.

SUMMARY OF THE INVENTION

It is an object of the invention to provide a portable depository container which obviates the disadvantage and problems discussed above in relation to known portable containers for valuable articles.

According to the invention there is provided a container for valuable articles, including locking means arranged to permit the deposit of said articles in the container when in an unlocked condition and to prevent the deposit of said articles in the container when in a locked condition, and resettable indicator means for indicating the number of times said locking means has been unlocked after the resetting of said indicator means.

DETAILED DESCRIPTION OF THE INVENTION

Figure 1:
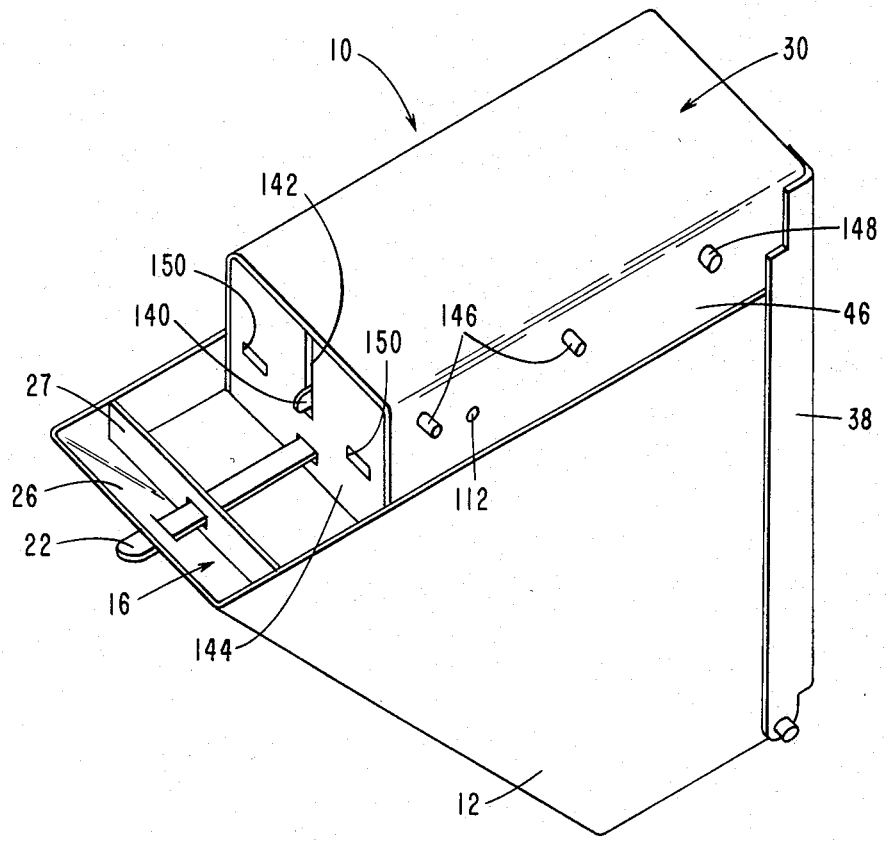
FIG. 1 is a perspective view of one embodiment of this invention showing a portable depository container suitable for the collection of magnetic cards, for example.
Figure 2:
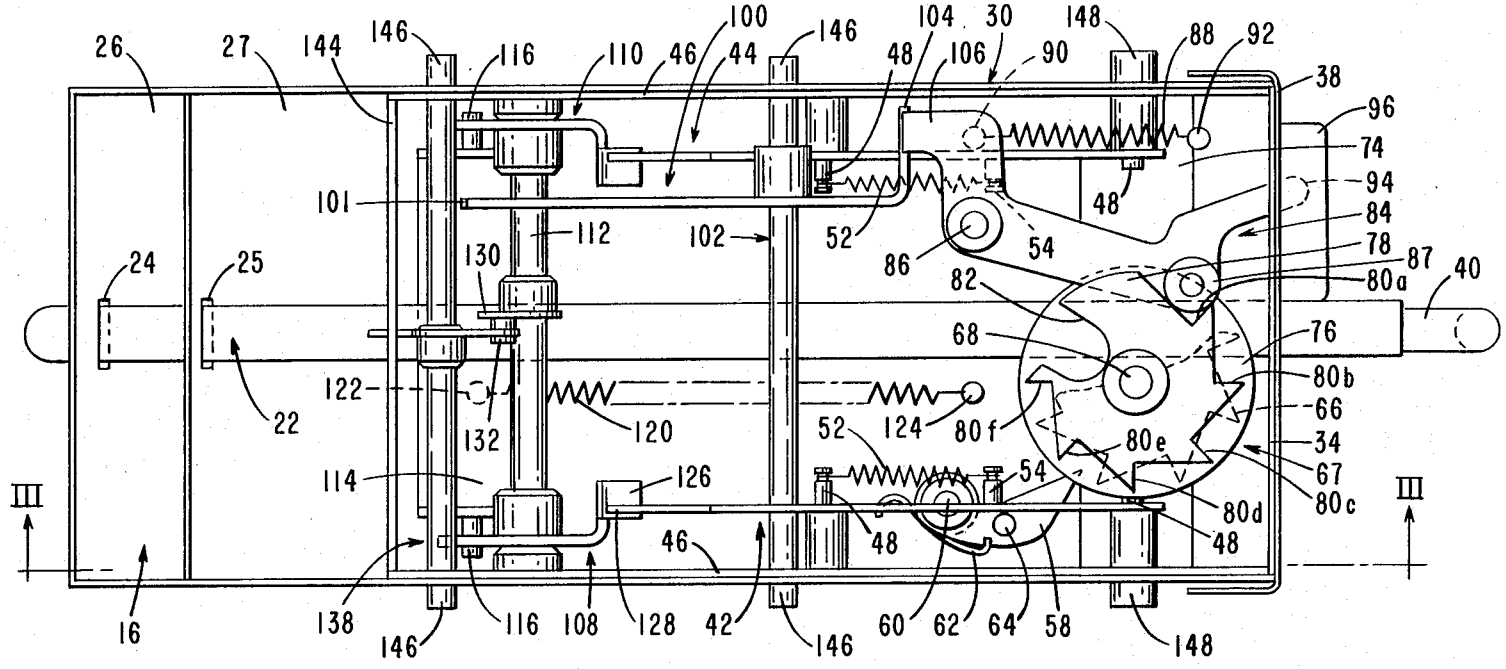
FIG. 2 is a plan view of the container of FIG. 1 with the top removed.
Figure 3:
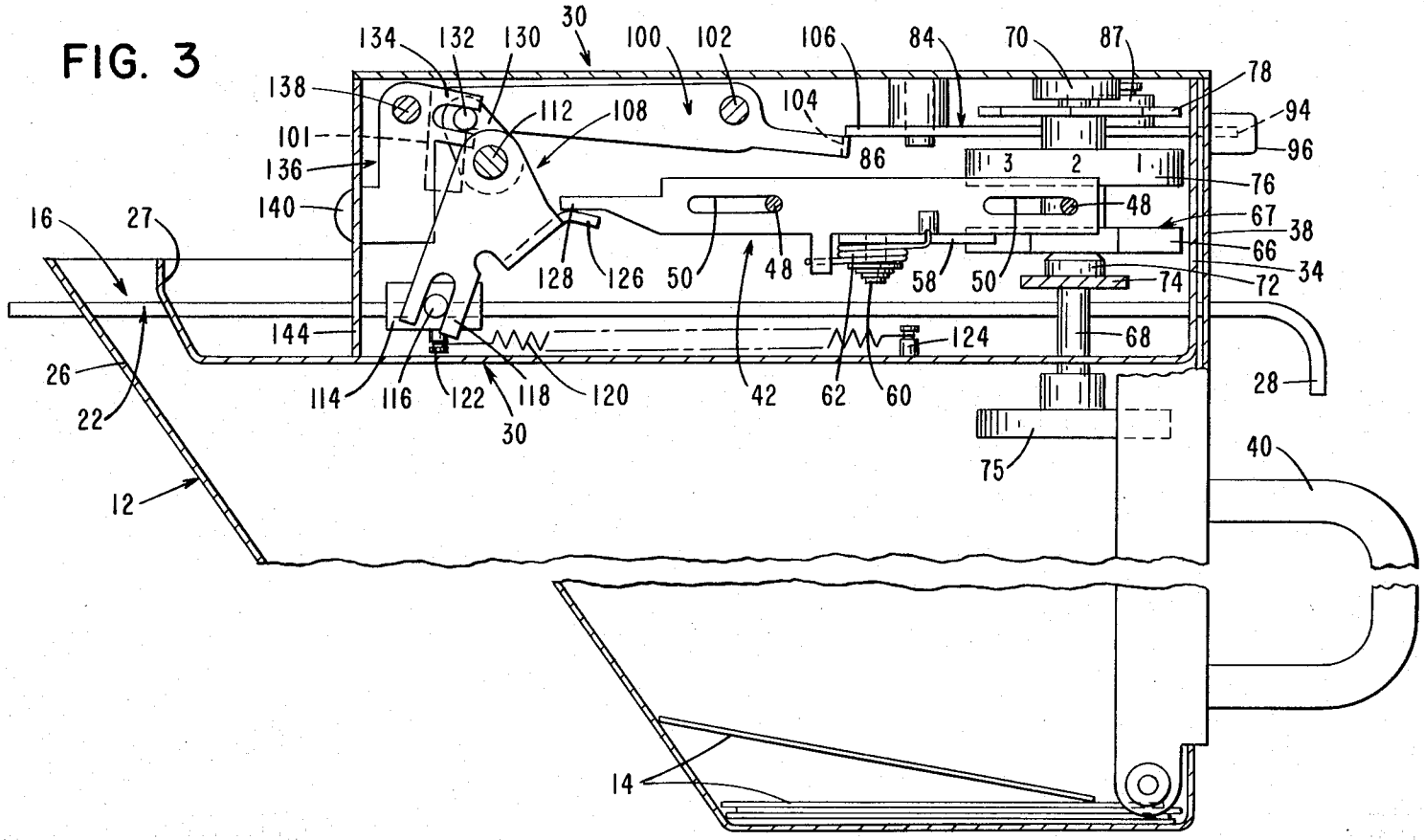
FIG. 3 is a sectional, side, elevational view of the container, the section being taken along the line III—III of FIG. 2.
Figure 4:
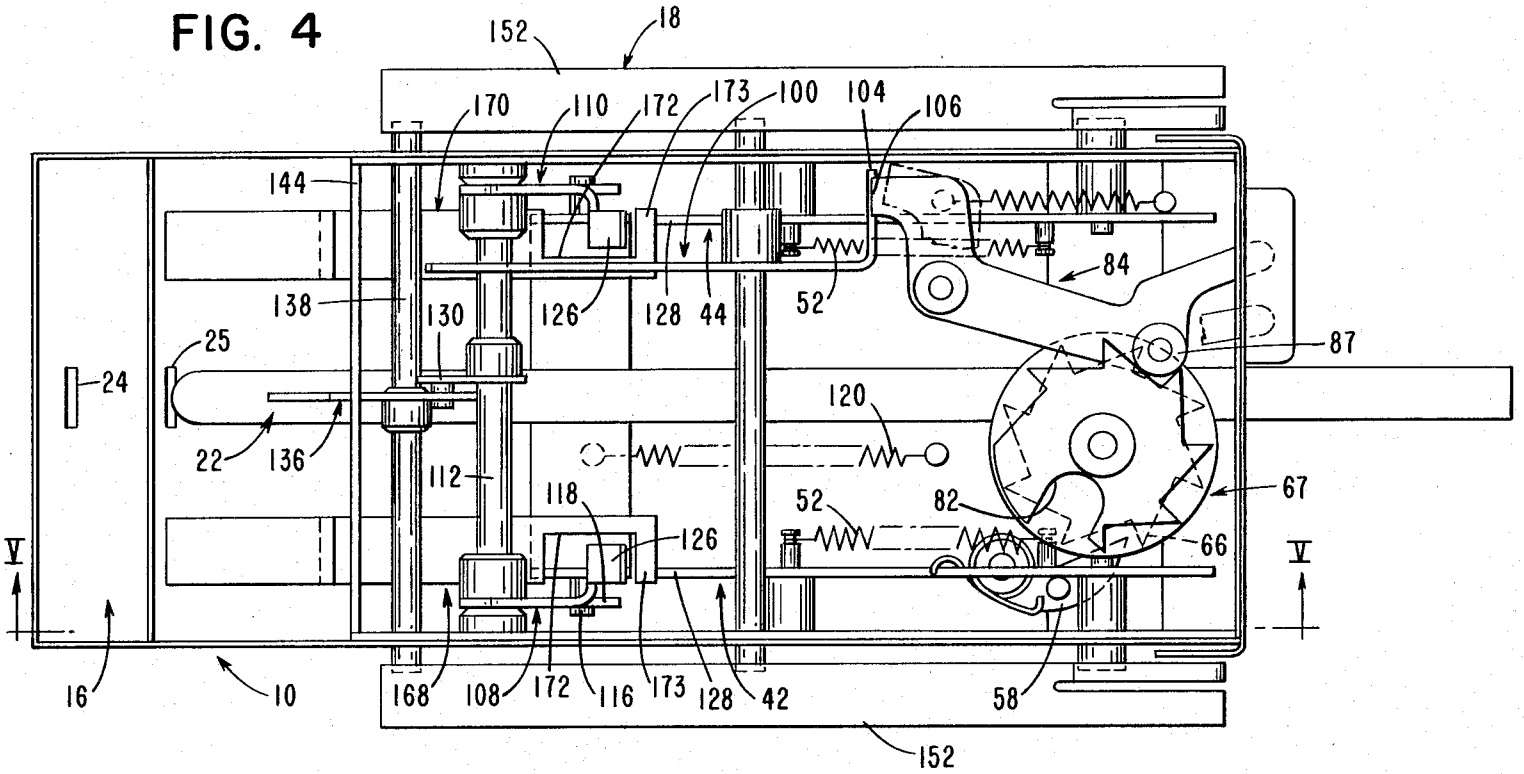
FIG. 4 is a plan view similar to FIG. 2 but showing the container when mounted in a receiving cradle of an ATM.
Figure 5:
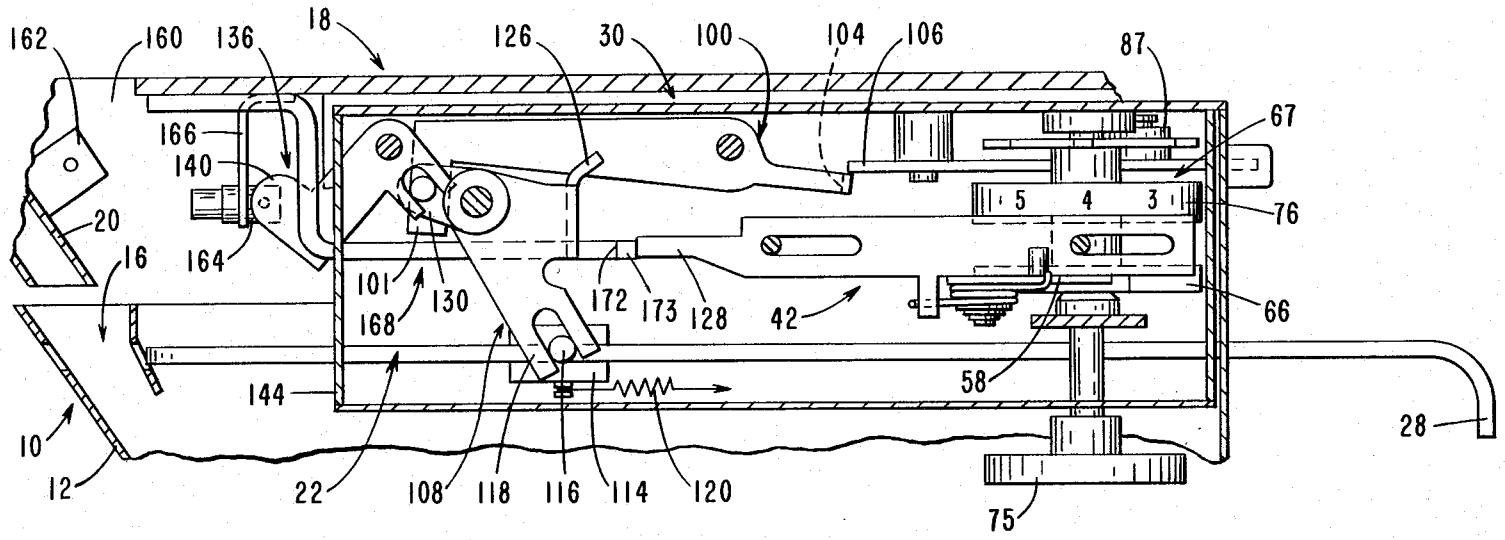
FIG. 5 is a sectional, side, elevational view of the container mounted in the receiving cradle, the section being taken along the line V—V of FIG. 4.

Referring particularly to FIGS. 1 to 3 of the drawing, the portable depository container 10 shown therein includes a receptacle 12 in which magnetic cards, for example, 14 (FIG. 3) are collected. In the top of the container 12 there is formed an entry slot 16 through which the cards 14 can be deposited in the container. As will be described in more detail later, the container 10 is arranged to be mounted on a cradle 18 (see FIGS. 4 to 6) which is fitted permanently and securely into an ATM (not shown). Magnetic cards 14 captured by the ATM are arranged to be dropped towards the entry slot 16 via a chute 20 (FIG. 5).

When the container 10 is not mounted on the cradle 18, the entry slot 16 is locked by means of a locking bar 22 so as to prevent the deposit of magnetic cards 14 into, or the removal of magnetic cards from, the receptacle 12 via the slot 16. As shown in FIGS. 1 to 3, when it is in a locking condition the locking bar 22 extends across the center of the entry slot 16, the bar 22 passing through slots 24 and 25 (FIG. 2) formed respectively, in the boundary walls 26 and 27 of the entry slot 16, and extending outside the outer boundary wall 26. The end of the bar 22 remote from the entry slot 16 is formed as a hook 28 (FIG. 3).

The locking bar 22 is slidably mounted in a casing 30 (best shown in FIG. 3) which is secured to, and mounted on top of, the receptacle 12. The bar 22 passes through a slot (not shown) in an end wall 34 of the casing 30 remote from the entry slot 16 and also passes through an opening 36 (FIG. 6) formed in a door 38 of the container 10. The door 38 is pivotally attached to the base of the receptacle 12, and is normally held in a closed position as shown in FIGS. 2 and 3 by means of a numbered seal (not shown). A carrying handle 40 is provided on the door 38.

Two slide members 42 and 44 (FIGS. 2, 3) are slidably mounted inside the casing 30, the members 42 and 44 being respectively disposed adjacent, and parallel to, the side walls 46 of the casing 30. Each slide member 42, 44 is slidably mounted on a respective pair of support studs 48 which are mounted on the adjacent side wall 46 and which respectively pass through two elongated slots 50 formed in the associated slide member. Each slide member 42, 44 is urged from right to left with reference to FIGS. 2 and 3 by means of a respective tension spring 52 one end of which is attached to the relevant support stud 48 and the other end of which is attached to a stud 54 secured to the slide member. With the container 10 dismounted from the cradle 18, the slide members 42 and 44 are normally held by means of the springs 52 in their forwardmost positions, that is to say their leftmost positions as shown in FIGS. 2 and 3.

A pawl 58 (FIG. 2) is pivotally mounted on the slide member 42, the pawl 58 being pivotable about a support stud 60 secured to the member 42. The pawl 58 is urged in a counter-clockwise direction with reference to FIG. 2 by means of a torsion spring 62, and with the container 10 dismounted from the cradle 18, the pawl 58 is normally held by the spring 62 in the position shown in FIG. 2 with a stop member 64 mounted on the pawl 58 in engagement with the slide member 42. The pawl 58 is adapted to engage a ratchet wheel 66 which has eight teeth equally spaced around its periphery and which forms part of a counter assembly 67 located inside the casing 30. The ratchet wheel 66 is secured on a shaft 68 of the counter assembly 67, the shaft 68 being rotatably mounted in an upper bearing 70 (FIG. 3) secured to the top of the casing 30 and a lower bearing 72 which is mounted on a bracket 74 extending across the casing 30. The lower portion of the shaft 68 passes through an opening in the base of the casing 30, and the lower end of the shaft 68 is provided with an actuating knob 75 positioned beneath the casing 30. The counter assembly 67 also includes an indicator wheel 76 which is secured on the shaft 68 above the ratchet wheel 66, the wheel 76 carrying on its outer periphery a series of markings consisting of a green area, a white area, and a series of five numerals from 2 to 6 on a red background.

A detent wheel 78 (FIG. 2), also included in the counter assembly 67, is secured on the upper portion of the shaft 68. As seen in FIG. 2, the detent wheel 78 incorporates six shallow detent notches 80*a*–80*f* and a seventh deep detent notch 82. The detent wheel 78 is associated with a detent arm lever 84 which is pivotally mounted on a stud 86 secured to the top of the casing 30. The lever 84 carries a detent roll 87 which is urged into engagement with one of the detent notches 80*a*–80*f* and 82 by means of a tension spring 88 (shown only in FIG. 2), the ends of the spring 88 being respectively attached to a stud 90 secured to the lever 84 and a stud 92 secured to the top of the casing 30. The lever 84 is provided with an actuating arm 94 which extends outside the casing 30, the arm 94 passing through a slot in the wall 34 with the end of the arm 94 being positioned behind an offset portion 96 of the door 38.

Figure 6:
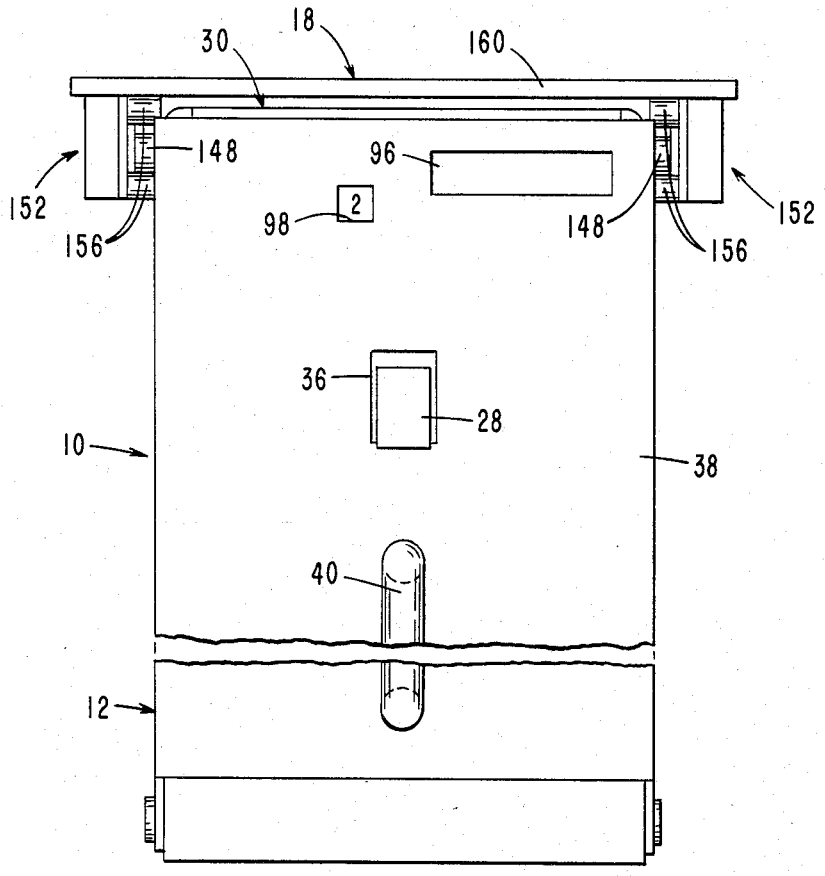
FIG. 6 is an end elevational view of the container mounted in the receiving cradle.

With the detent roll 87 (FIG. 2) in engagement with the first shallow detent notch 80*a*, a full rearward movement of the slide member 42 from left to right with reference to FIGS. 2 and 3 (brought about in a manner to be described later) causes the pawl 58 to engage one of the teeth of the ratchet wheel 66 so as to rotate the counter assembly 67 (consisting of the ratchet wheel 66, the shaft 68, the indicator wheel 76, and the detent wheel 78) through one eighth of a revolution and to bring the detent roll 87 into engagement with the next detent notch 80*b*. During a return movement of the slide member 42 from right to left, the pawl 58 rides over a tooth of the ratchet wheel 66, and a subsequent full rearward movement of the slide member 42 from left to right brings about a further rotation of the counter assembly 67 through one eighth of a revolution so as to bring the detent roll 87 into engagement with the next detent notch 80*c*. Each successive full rearward movement of the slide member 42 brings about a further indexing of the counter assembly 67 through one eighth of a revolution until such time as the detent roll 87 is urged into the deep, detent notch 82. After the roll 87 has engaged the notch 82, further indexing of the counter assembly 67 is prevented until the roll 87 is lifted out of the notch 82 by means of the actuating arm 94. The rotational position of the counter assembly 67, corresponding to the particular detent notch with which the detent roll 87 is engaged, is indicated by the particular marking on the indicator wheel 76 visible through an indicator window 98 (FIG. 6) formed in the door 38. Thus, when the roll 87 is in engagement with the detent notch 80*a*, the green area shows through the indicator window 98; when the roll 87 is in engagement with the notch 80*b*, the white area shows through the window 98; and when the roll 87 is in engagement with the notch 80*c*, 80*d*, 80*e*, 80*f* or 82, the numeral 2, 3, 4, 5 or 6, respectively, shows through the window 98 (FIGS. 4 to 6 show the counter assembly 67 so positioned that the numeral 2 shows through the window 98).

A blocking arm 100 (FIG. 3), having a downwardly projecting portion 101, is associated with the detent arm lever 84, the blocking arm 100 being pivotally mounted inside the casing 30 on a rod 102 which is secured to, and extends across, the casing 30. Normally, with the detent roll 87 in engagement with one of the shallow detent notches 80*a*–80*f*, a lateral projection 104 (FIG. 4) formed at one end of the blocking arm 100 engates an end portion 106 of the detent arm lever 84, this position of the blocking arm 100 being hereinafter referred to as its latched position. The projection 104 is held in engagement with the portion 106 by virtue of gravity urging the blocking arm 100 in a counter-clockwise direction with reference to FIG. 3. Upon the detent roll 87 moving into engagement with the deep detent notch 82, resulting in the detent arm lever 84 being pivoted into the position shown in dotted outline in FIG. 4, the portion 106 is moved out of engagement with the projection 104, thereby permitting the portion 101 (FIG. 5) of blocking arm 100 to fall under gravity for a purpose which will be described later herein.

A pair of locking pawls 108 and 110 (FIGS. 4, 5) is secured on a shaft 112 which is rotatably mounted inside, and extends across, the casing 30, the pawls 108 and 110 being associated with the slide members 42 and 44, respectively. A transversely-extending bracket 114 (best shown in FIG. 5) is secured to the locking bar 22, and two outwardly projecting studs 116 are provided, respectively, at the ends of the bracket 114. Each stud 116 fits in a bifurcated portion 118 of a respective one of the pawls 108 and 110 as shown in FIG. 3. Thus, it will be appreciated that movement of the locking bar 22 will bring about rotational movement of the assembly of the shaft 112 and locking pawls 108 and 110 by virtue of the engagement of the studs 116 in the bifurcated portions 118. The locking bar 22 is urged to move from left to right with reference to FIGS. 2 and 3 by means of a tension spring 120, one end of which is attached to a stud 122 mounted on the bracket 114, and the other end of which is attached to a stud 124 secured to the base of the casing 30. With the container 10 dismounted from the cradle 18, and the slide members 42 and 44 in their leftmost positions as shown in FIGS. 2 and 3, a lug 126 (FIGS. 3, 4, and 5) provided on each locking pawl 108, 110 is urged into engagement with an end portion 128 of the respective slide member 42 or 44 under the action of the spring 120, thereby locking the locking bar 22 in the position shown in FIGS. 1 to 3 in which it extends across the entry slot 16.

Also secured on the shaft 112 is an arm 130 (FIGS. 3, 4) carrying a stud 132. The stud 132 engages a bifurcated portion 134 of a flag member 136, the member 136 being pivotally mounted on a rod 138 which is secured to and extends across the casing 30. A projecting portion 140 of the flag member 136 extends through a vertically extending slot 142 (FIG. 1) formed in the end wall 144 of the casing 30 remote from the handle 40. With the container 10 dismounted from the cradle 18, the stud 132 holds the flag member 136 in the position shown in FIG. 3. Upon the slide members 42 and 44 and the locking bar 22 being moved from left to right with reference to FIG. 3 in a manner to be described later, the assembly of the shaft 112, the locking pawls 108, and the arm 130 rotates in an counter-clockwise direction, thereby bringing about a rotation of the flag member 136 in a clockwise direction by virtue of the engagement of the stud 132 in the bifurcated portion 134.

The casing 30 is provided with two pairs of external guide studs 146 (FIG. 1) and a pair of larger external latching studs 148, each pair of guide studs 146 and each latching stud 148 being located on a respective side wall 46 of the casing 30; the studs 146 are formed by portions of the rods 102 and 138 (FIG. 2) extending outside the casing 30. A pair of horizontally extending slots 150 (FIG. 1) is formed in the end wall 144 of the casing 30.

Figure 7:
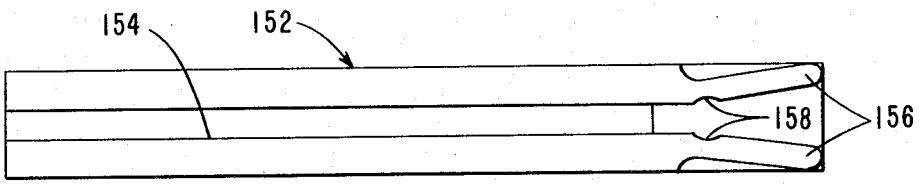
FIG. 7 is a side elevational view of one of a pair of guide rails included in the receiving cradle.

Reference will now be made particularly to FIGS. 4 to 6 in which the container 10 is shown mounted in the cradle 18. The cradle 18 includes a pair of guide rails 152 in each of which is formed a longitudinally extending groove 154 (FIG. 7). Each rail 152 is provided at one end with a pair of spring fingers 156, in each of which is formed a recess 158 (FIG. 7). When mounting the container 10 in the cradle 18, the guide studs 146 are slid into the grooves 154, and the container 10 is moved along the guide rails 152 until each latching stud 148 enters with a snap action into the recesses 158 in the spring fingers 156 of the respective rail 152, the fingers 156 thereby holding the container 10 in its fully inserted position in the cradle 18.

The chute 20 (shown only in FIG. 5) is mounted on the main body 160 (not shown in FIG. 4) of the cradle 18 by means of a bracket 162, and the chute 20 is so positioned that with the container 10 fully inserted in the cradle 18, the lower end of the chute is positioned immediately above the entry slot 16. If desired, an optical sensing device (not shown) can be mounted adjacent to the lower end of the chute 20 for the purpose of sensing when the receptacle 12 has been filled with captured cards 14. An optical sensing device 164 (shown only in FIG. 5) is mounted on the main body 160 of the cradle 18 by means of a bracket 166, the device 164 being positioned adjacent to the projecting portion 140 of the flag member 136.

The cradle 18 is provided with two specially-shaped, key plates or pins 168 and 170 which each have a cutaway portion 172, the pins 168, 170 being secured to the main body of the cradle 18 and extending parallel to the guide rails 152. It will be assumed that prior to the container 10 being mounted in the cradle 18, the container 10 is in its normal dismounted condition with the slide members 42 and 44 in their forwardmost positions and with the blocking arm 100 in its latched position. As the container 10 is moved along the guide rails 152 while being mounted in the cradle 18, the key pins 168, 170 respectively enter the two slots 150 in the end wall 144 of the casing 30, and the leading ends 173 of the key pins 168, 170 respectively come into engagement with the end portions 128 of the slide members 42 and 44. Continued movement of the container 10 brings about rearward movement of the slide members 42 and 44 (from left to right with reference to FIGS. 4 and 5) until the associated latch studs 148 snap into the recesses 158, at which time the slide members 42 and 44 are in the positions shown in FIGS. 4 and 5. As previously explained, this rearward movement of the slide members 42, 44 causes the counter assembly 67 to rotate through one eighth of a revolution by virtue of the engagement of the pawl 58 with a tooth of the ratchet wheel 66. Also, this rearward movement of the slide members 42 and 44 moves their end portions 128 out of engagement with the lugs 126 of the locking pawls 108 and 110, thereby enabling the locking bar 22 to move rearwardly under the action of the spring 120, the locking pawls 108 and 110 rotating in a counter-clockwise direction into the position shown in FIG. 5 with the lugs 126 passing through the cutaway portions 172 of the key pins 168, 170. This rotation of the locking pawls 108 and 110 brings about a rotation in a counter-clockwise direction of the arm 130 which in turn rotates the flag member 136 in a clockwise direction into the position shown in FIG. 5 in which the projection 140 can be detected by the optical sensing device 164. Assuming that the detent roll 87 has not been moved into engagement with the deep detent notch 82, the blocking arm 100 remains in its latched position with the lower end of the portion 101 (FIG. 5) being disposed slightly above the key pin 170.

It will be appreciated that, by virtue of the lugs 126 extending through the cutaway portions 172 of the key pins 168 and 170, the container 10 cannot be removed from the cradle 18 until such time as the locking bar 22 is moved forwardly by means of the hook 28; such forward movement brings about a clockwise rotation (with reference to FIG. 5) of the locking pawls 108 and 110 under the action of the studs 116 engaging the bifurcated portions 118, and thereby moves the lugs 126 out of engagement with the key pins 168 and 170.

Figure 8:
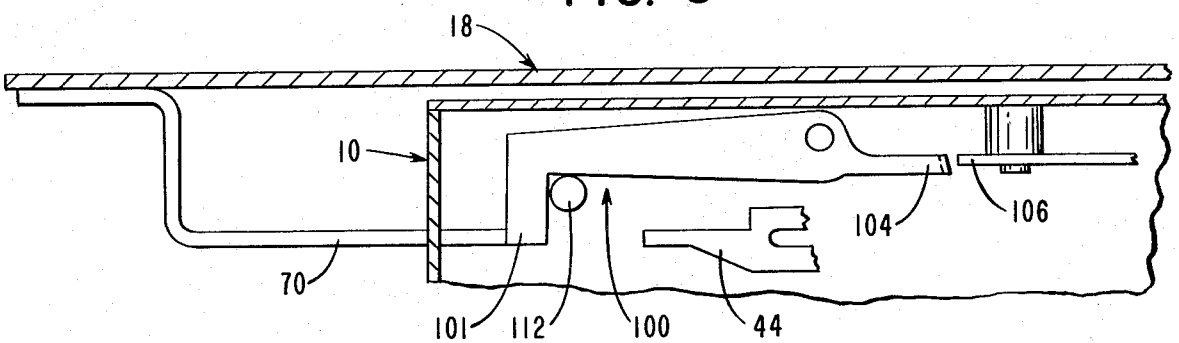
FIG. 8 is a sectional, side, elevational view of part of the container and receiving cradle, showing a blocking member of the container in an unlatched condition.

If the rearward movement of the slide members 42 and 44, brought about by the key pins 168 and 170, causes the detent roll 87 to move into engagement with the deep detent notch 82 (FIG. 4), then, as previously explained, the portion 106 of the detent arm lever 84 is moved out of engagement with the projection 104 of the blocking arm 100. Upon the blocking arm 100 being thus released by the detent arm lever 84, the portion 101 (FIG. 5) of the arm 100 falls under gravity until its lower end rests on the upper surface of the key pin 170. During removal of the container 10 from the cradle 18 following release of the blocking arm 100, the lower end of the portion 101 rides over the key pin 170 until the portion 101 is moved beyond the end of the key pin 170. Thereafter, the portion 101 drops further to the position shown in FIG. 8, the arm 100 at this stage resting on the shaft 112. It will be appreciated that with the blocking arm 100 in this position, further mounting of the container 10 in the cradle 18 is prevented, since full movement of the container 10 along the guide rails 152 is blocked by virtue of the end of the key pin 170 abutting against the dropped portion 101 of the arm 100 as shown in FIG. 8. Also, this blocking by the arm 100 of full movement of the container 10 along the rails 152 prevents possible impact damage to the counter assembly 67 while the latter is locked against rotation due to the detent roll 87 being in engagement with the deep detent notch 82.

The operation of the container 10 will now be described. Normally, before the container 10 is mounted in the cradle 18 the counter assembly 67 is set so that the green area marking of the indicator wheel 76 shows through the indicator window 98 (FIG. 6), and the blocking arm 100 is set to its latched position. Before either of these settings is made, it is necessary to open the door 38 (FIG. 6) so as to obtain access to the knob 75 (FIG. 3) and the actuating arm 94 (FIG. 2) of the detent arm lever 84. The required setting of the counter assembly 67 is made by holding the detent roll 87 out of engagement with the detent wheel 78 by means of the actuating arm 94 and at the same time, rotating the assembly by means of the knob 75 in a clockwise direction with reference to FIG. 2 so as to bring the detent roll 87 into engagement with the detent notch 80*a*. If the blocking arm 100 is in its unlatched position as shown in FIG. 8, then in order to latch the arm 100, it is necessary to rotate the detent arm lever 84 in a counter-clockwise direction with reference to FIG. 2 by means of the actuating arm 94. This rotational movement of the lever 84 brings the portion 106 thereof into engagement with the projection 104 of the blocking arm 100, the projection 104 presenting an inclined face to the portion 106 as shown in FIG. 8. Continued rotational movement of the lever 84 causes the portion 106 to move the projection 104 downwardly by a camming action until the arm 100 is set to its latched position as shown in FIG. 3 with the projection 104 in engagement with the lower surface of the portion 106. After any magnetic cards 14 or other articles have been removed from the receptacle 12, the door 38 is then closed, and a seal is applied, sealing the door 38 in its closed position. The green marking showing through the indicator window 98 (FIG. 6) indicates to a user of the container 10 that it can be inserted up to six times into a cradle of an ATM, such as the cradle 18, without the necessity of any resetting of the blocking arm 100 and counter assembly 67.

The sealed empty container 10 is then taken to an ATM where it is mounted in the receiving cradle 18 in the manner described previously. During the mounting operation, the slide members 42, 44 are moved rearwardly by the key pins 168 and 170 so as to rotate the counter assembly 67 through one eighth of a revolution by means of the pawl 58, the detent roll 87 engaging in the next detent notch 80*b*, and the white marking of the indicator wheel 76 showing through the indicator window 98. The rearward movement of the slide members 42 and 44 also brings about a rearward movement of the locking bar 22 into the position shown in FIGS. 4 and 5 in the manner previously described. With the locking bar 22 removed from the entry slot 16 as shown in FIGS. 4 and 5, magnetic cards 14 captured by the ATM can fall via the chute 20 and the entry slot 16 into the receptacle 12 where they are securely held until such time as the seal is broken and the door 38 is opened. Also during the mounting operation, the flag member 136 is rotated into the position shown in FIG. 5 in which the projection 140 is in cooperative relationship with the optical sensing device 164. In operation of the ATM, the device 164 senses the projection 140 and generates an electrical signal indicating that the container 10 is correctly mounted in the cradle 18 of the ATM.

For all the time that the entry slot 16 is open for receipt of cards 14 captured by the ATM, the container 10 is held locked in the cradle 18 by virtue of the lugs 126 extending through the cutaway portions 172 of the key pins 168 and 170. It should be understood that the cradle 18 is so constructed that with the container 10 mounted therein, access to the contents of the receptacle 12 via the entry slot 16 is impossible. As previously described, the container 10 cannot be removed from the cradle 18 until such time as the locking bar 22 has been moved forwardly so as to restore it to its locking position extending across the entry slot 16; when the locking bar 22 is in this position, it prevents removal via the slot 16 of any cards 14 held in the receptacle 12.

When it is desired to remove from the container 10 any cards 14 held in the receptacle 12, the container 10 is normally first removed from the cradle 18 by restoring the locking bar 22 to its locking position shown in FIG. 3 by means of the hook 28 and then sliding the container 10 along the guide rails 152 out of the cradle 18. The container 10 will then normally be taken to a secure or authorized area, e.g. in a bank, for the container 10 to be opened; this area may be at a location remote from the building in which the ATM is situated. Before the door 38 is opened, a check is made to ascertain that the seal has not been broken, that the locking bar 22 is in its fully locked position, and that the marking showing through the indicator window 98 is noted. If the white area shows through the window 98 this indicates that only a single insertion of the container 10 into the cradle 18 of the ATM has been made since the container was sealed and that therefore no unauthorized unlocking of the locking bar 22 has taken place. The seal can then be broken, the door 38 opened, and the contents of the container 10 removed from the receptacle 12.

If one of the numerals 2 to 6 on a red background shows through the window 98, this indicates that the locking bar 22 has been unlocked more than once since the container 10 was sealed, the number of times that the container has been unlocked corresponding to the numeral showing through the window 98. This can mean that the container 10 has been inserted more than once in the cradle 18, or that following removal of the container 10 from the ATM, unauthorized unlocking of the locking bar 22 has taken place, for example, by the use of elongated implements inserted through the slots 150 (FIG. 1). Accordingly, when one of numerals 2 to 6 shows through the window 98, an explanation will normally be required. A possible legitimate explanation could be that it was necessary to remove the container 10 from the ATM on one or more occasions to permit servicing of the latter, or that the counter assembly 67 had been accidentally rotated by more than one notch of the ratchet wheel 66 due to a fumbled insertion of the container 10 into the cradle 18. On the other hand, the lack of an acceptable explanation could indicate that tampering with the container 10 has taken place following its removal from the ATM. An explanation will also be required if the locking bar 22 is held out of its fully locked position due to one or each of the lugs 126 being trapped in contact with the upper surface of the end portion 128 (FIGS. 4, 5) of the respective slide member 42 or 44, since this also could indicate that tampering with the container 10 has taken place following its removal from the ATM. Thus, if an unauthorized attempt has been made to move the locking bar 22 to an unlocked position by moving the slide members 42, 44 rearwardly using elongated implements inserted through the slots 150, then there is a good possibility that, following a rotation of the locking pawls 108 and 110 in a counter-clockwise direction with reference to FIG. 3, one or each of the end portions 128 will be urged by the relevant spring 52 underneath the respective lug 126 upon said implements being disengaged from the slide members 42, 44. Once a lug 126 has been trapped in this way, it is virtually impossible to free it using an implement inserted through the respective slot 150 since access to the respective end portion 128 is barred by the respective locking pawl 108 or 110.

It will be appreciated that the container 10 has the capability of being inserted up to six times into the cradle 18 without the necessity of returning the container 10 to the secure area for unsealing of the door 38. As previously explained, following the sixth insertion, the numeral 6 shows through the window 98, and the container 10 is locked against a further insertion into the cradle 18 due to the engagement of the detent roll 87 in the deep detent notch 82. It will then be necessary to return the container 10 to the secure area for unsealing of the door 38 and relatching of the blocking arm 100.

If desired, the number of possible insertions of the container 10 into the cradle 18 can be restricted to a number less than six. This is done by initially setting the counter assembly 67 (FIG. 4) to a position in which the detent roll 87 is in engagement with one of the detent notches 80*a*–80*f* other than the notch 80*a*. For example, if the counter assembly 67 is initially set to a position in which the roll 87 is in engagement with the notch 80*c* (corresponding to the numeral 2 showing through the window 98), then up to four insertions of the container 10 in the cradle 18 will be permitted.

It will be appreciated that a container 10, made in accordance with the present invention, is not restricted to the collection and retention of magnetic cards, but may be used for the collection and retention of other valuable articles such as envelopes containing currency notes.

Figure 9:
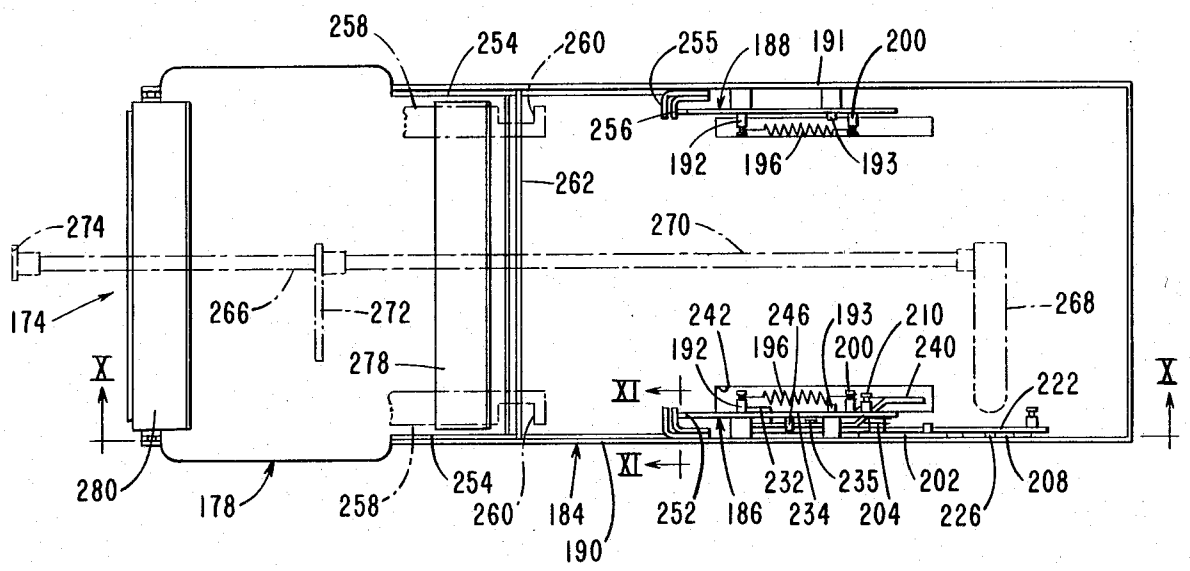
FIG. 9 is a plan view of another embodiment of the invention showing a portable depository container suitable for the collection of envelopes containing currency notes, the top of the container being removed.
Figure 10:
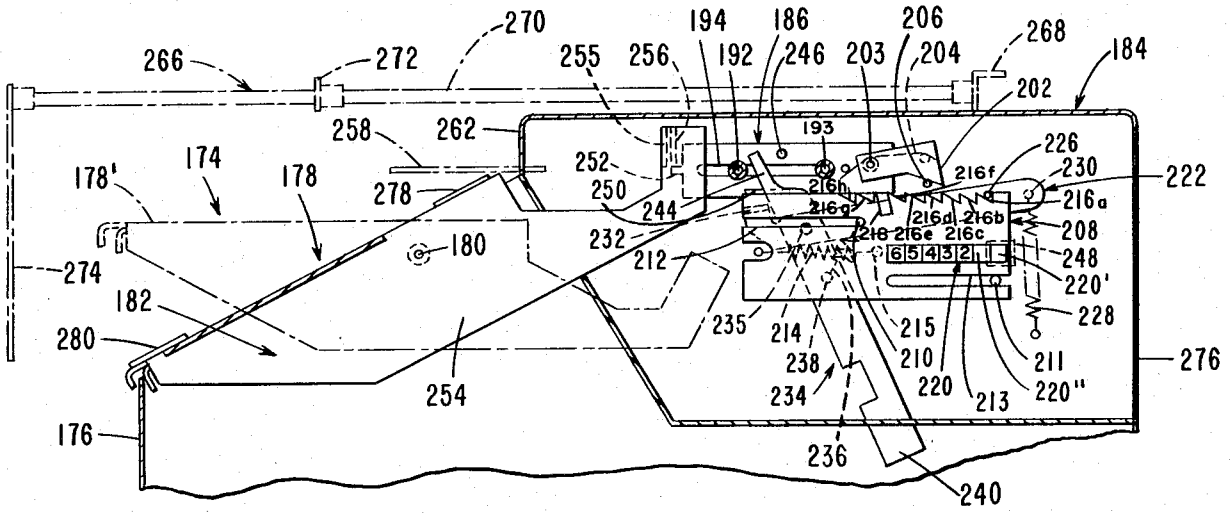
FIG. 10 is a sectional, side, elevational view of the container of FIG. 9, the section being taken along the line X—X of FIG. 9.
Figure 11:
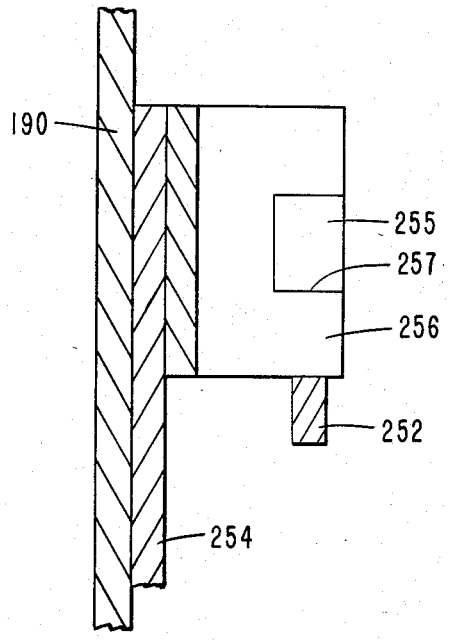
FIG. 11 is an enlarged sectional view taken along the line XI—XI of FIG. 9.

Referring now to FIGS. 9 to 11, there is shown therein a second embodiment of the present invention in the form of a portable, depository container 174 designed for the collection and retention of envelopes containing currency notes. The container 174 includes a receptacle 176 (FIG. 10) in which the envelopes are collected. At the top of the receptacle 176 there is provided a door 178 which is pivotally mounted on support means 180. Upon the door 178 being pivoted into its open position 178', shown in dotted outline in FIG. 10, an opening 182 is provided in the container 174 via which the envelopes may be deposited into the receptacle 176. The container 174 is adapted to be inserted in a cradle (not shown) of an ATM.

A casing 184 (FIGS. 9, 10) is mounted on the upper part of the receptacle 176. Two slide members 186 and 188 are slidably mounted inside the casing 184, the members 186, 188 being respectively disposed adjacent, and parallel to, the side walls 190 and 191 of the casing 184. Each slide member 186, 188 is slidably mounted on a respective pair of studs 192 and 193 which are mounted on the adjacent side wall 190, 191 and which pass through an elongated slot 194 (FIG. 10) formed in the slide member. Each slide member 186, 188 is urged from right to left with reference to FIGS. 9 and 10 by means of a respective tension spring 196 (shown only in FIG. 9), one end of which is attached to the respective stud 192 secured to the adjacent side walls 190 and 191 and the other end of which is attached to a stud 200 secured to the slide member. With the container 174 dismounted from the ATM, the slide members 186 and 188 are normally held by means of the springs 196 in their forwardmost positions, that is to say in their leftmost positions as shown in FIGS. 9 and 10.

A pawl 202 (FIGS. 9 and 10) is pivotally mounted on the slide member 186, the pawl 202 being pivotable about a support stud 203 secured to the member 186. The pawl 202 is urged in a clockwise direction with reference to FIG. 10 by means of a torsion spring 204, and with the container dismounted from the ATM, the pawl is normally held by the spring 204 in engagement with a stop member 206 secured to the adjacent side wall 190. The pawl 202 is adapted to engage a counter slide 208 which is slidably mounted on a pair of support studs 210 and 211 mounted on the side wall 190, the studs 210 and 211 respectively passing through two elongated slots 212 and 213 formed in the counter slide 208. The counter slide 208 is urged from right to left with reference to FIG. 10 by means of a tension spring 214, one end of which is attached to a stud 215 mounted on the slide 208 and the other end of which is attached to the side wall 190. On the upper surface of the counter slide 208, there is provided a plurality of notches consisting (from right to left with reference to FIG. 10) of a series of six shallow notches 216*a* to 216*f*, a deep notch 218, and two further shallow notches 216*g* and 216*h*. The pawl 202 is adapted to engage one of the seven notches consisting of the notches 216*c* to 216*f*, the notch 218 and the notches 216*g* and 216*h*. On the surface of the slide member 186 adjacent the side wall 190, there is provided a series of markings 220 consisting of a green area 220', a white area 220" and five numerals 2 to 6, each numeral being on a red background.

A detent lever 222 (FIGS. 9, 10) is pivotally mounted on the stud 210. The lever 222 carries near one end a detent roll 226 which is urged into engagement with one of the notches 216*a*–216*f* and 218 by means of a tension spring 228 (shown only in FIG. 10), one end of the spring 228 being attached to a stud 230 mounted on the end of the lever 222 adjacent the roll 226 and the other end of the spring 228 being attached to the side wall 190. On the upper part of that end of the detent lever 222 remote from the stud 230, there is provided a lug 232. An actuating arm 234 is pivotally connected to the lever 222 by means of a stud 235, the arm 234 being normally urged into engagement with the lug 232 by means of a tension spring 236 (shown only in FIG. 10) one end of which is attached to a stud 238 mounted on the arm 234 and the other end of which is attached to the stud 210. A lower end portion 240 of the arm 234 extends through a slot 242 (FIG. 9) formed in the base of the casing 184. The upper end of the arm 234 is formed as a finger 244 which, upon rotational movement of the arm 234 in a clockwise direction with reference to FIG. 10, is adapted to engage a stud 246 mounted on the slide member 186.

With the detent roll 226 in engagement with the first notch 216*a*, a full rearward movement of the slide member 186 from left to right with reference to FIGS. 9 and 10 (brought about in a manner to be described later) causes the pawl 202 to slide off the stop member 206 and engage the notch 216*c* so as to move the counter slide 208 through one notch position and bring the detent roll 226 into engagement with the notch 216*b*. During a return movement of the slide member 186 from right to left, the pawl 202 rides back up the stop member 206, and a subsequent, full, rearward movement of the slide member 186 from left to right brings about a further indexing of the counter slide 208 through one notch position so as to bring the detent roll 226 into engagement with the notch 216*c*. Each successive, full, rearward movement of the slide member 186 brings about a further indexing of the counter slide 208 through one notch position until such time as the detent roll 226 is urged into the deep detent notch 218. After the detent roll 226 has engaged the notch 218, further movement of the counter slide 208 is prevented until the roll 226 is lifted out of the notch 218. The position of the counter slide 208, corresponding to the particular detent notch into which the detent roll 226 is engaged, is indicated by the particular marking 220 on the counter slide 208 visible through an indicator window 248 (FIG. 10) formed in the side wall 190 of the casing 184. Thus, when the roll 226 is in engagement with the detent notch 216*a*, the green area 220' shows through the indicator window 248; when the roll 226 is in engagement with the notch 216*b*, the white area 220'' shows through the window 248; and when the roll 226 is in engagement with the notch 216*c*, 216*d*, 216*e*, 216*f* or 218, the numeral 2, 3, 4, 5 or 6, respectively, shows through the window 248.

Following engagement of the detent roll 226 (FIG. 10) with the deep notch 218 and upon the slide member 186 returning to its forwardmost position, the deep notch permits pivotal movement of the detent lever 222 under the action of the spring 228 so as to bring the lug 232 into engagement with a recess 250 formed in the lower edge of the slide member 186. With the lug 232 in engagement with the recess 250, the slide member 186 is locked against any further rearward movement.

That end of each of the slide members 186 and 188 nearer the door 178 is provided with a projection 252. The door 178 incorporates side members 254 which each project into the interior of the casing 184 through slots (not shown) and which each have two inwardly projecting lugs 255 and 256 positioned adjacent the respective one of the slide members 186 and 188; each of the lugs 256 has a recess 257 formed in its vertical edge as seen in FIG. 11. With the slide members 186 and 188 in their forwardmost positions as shown in FIGS. 9 and 10, the projection 252 of each slide member engages the lower end of the respective lug 256, thereby preventing any rotational movement of the door 178 in a clockwise direction with reference to FIG. 10 and so locking the door 178 in its closed position. The purpose of the lugs 255 and of the recess 257 in each lug 256 will be explained later.

The container 174 is provided with guide means (not shown) for guiding the container into a fully inserted position in the receiving cradle of the associated ATM. The cradle is provided with two specially shaped key plates or pins 258, schematically indicated in FIGS. 9 and 10, the key pins 258 each being provided with a cutaway portion 260 and extending parallel to the direction of movement of the container 174 when the latter is being inserted in the cradle. It will be assumed that prior to the container 174 being mounted in the cradle, the container is in its normal dismounted condition with the slide members 186 and 188 in their forwardmost positions and with the detent lever 222 latched out of engagement with the slide member 186 (that is to say with the detent roll 226 in engagement with one of the shallow notches 216*a* to 216*f*). As the container 174 is being inserted in the cradle, the key pins 258 respectively pass through two slots (not shown) formed in the front wall 262 of the casing 184 and respectively come into engagement with the projections 252 of the slide members 186 and 188. Continued movement of the container 174 towards its fully-inserted position brings about a rearward movement of the slide member 186 by an extent sufficient to cause the pawl 202 to move the counter slide 208 rearwardly through one notch position, the detent roll 226 being brought into engagement with the next detent notch. Assuming that the detent roll 226 has not been moved into engagement with the deep detent notch 218, the detent lever 222 remains latched out of engagement with the slide member 186.

When the container 174 is in its fully-inserted position in the cradle, the door 178 is unlocked, because the projections 252 on the slide members 186 and 188 have been moved out of engagement with the lugs 256, thereby permitting the door to be pivoted to its open position 178' with the lugs 256 passing through the cutaway portions 260 of the key pins 258. The cradle is provided with a door opening mechanism 266 schematically shown in FIGS. 9 and 10. The mechanism 266 incorporates a handle 268 which is connected via a shaft 270 with a door opening arm 272 and with a door closing arm 274, the shaft 270 being rotatably mounted in the cradle. As indicated in FIGS. 9 and 10, the handle 268 and the arms 272 and 274 are so arranged that prior to, and during, the insertion of the container 174 in the cradle, the handle 268 and the door opening arm 272 extend horizontally from the shaft 270, and the door closing arm 274 extends vertically downwardly from the shaft 270. Following the full insertion of the container 174 in the cradle, the handle 268 is manually rotated into a downwardly extending position in which it holds the container 174 in its fully-inserted position by virtue of being in engagement with the adjacent end wall 276 (FIG. 10) of the casing 184. This rotational movement of the handle 268 rotates the door opening arm 272 into a downwardly extending position in which it contacts a contact plate 278 on the upper surface of the door 178 and thereby rotates the latter into its open position 178'; at the same time the door closing arm 274 is rotated into a horizontally extending position out of engagement with the door 178. In order to remove the container 174 from the cradle, the handle 268 is rotated back to its horizontal position, thereby rotating the door opening arm 272 back to its horizontal position out of engagement with the door 178 and rotating the door closing arm 274 into a downwardly extending position in which it contacts a contact plate 280 on the upper surface of the door 178 and so positively restores the door to its closed position.

The operation of the container 174 will now be described. Normally, before the container 174 is mounted in the cradle of the associated ATM, the counter slide 208 is set so that the green area 220' shows through the indicator window 248 (FIG. 10). Before this setting is made it is necessary to open a door (not shown) of the receptacle 176 so as to obtain access to the end portion 240 of the actuating arm 234 extending below the casing 184. The required setting is made by pulling downwardly on the portion 240. This action causes the detent lever 222 to rotate in a counter-clockwise direction with reference to FIG. 10 so as to lift the detent roll 226 out of the detent notch in which it is engaged. Upon the detent roll 226 being lifted, the counter slide 208 is returned by the spring 214 to its forwardmost position as determined by the stud 210, and then, upon the portion 240 being released, the spring 228 moves the detent roll 226 into engagement with the first detent notch 216*a*. It will be appreciated that following this setting operation, the detent lever 222 will be latched out of engagement with the slide member 186. After any currency-containing envelopes or other articles have been removed from the receptacle 176, the door of the receptacle 176 is closed, and a seal is applied, sealing the door in its closed position. The green area 220' showing through the indicator window 248 indicates to a user of the container 174 that it can be inserted up to six times into an ATM without the necessity of any resetting of the counter slide 208.

The sealed, empty container 174 is then taken to an ATM where it is mounted in the receiving cradle in the manner previously described. During the mounting operation, the slide members 186, 188 are moved rearwardly by the key pins 258 so as to move the counter slide 208 rearwardly through one notch position by means of the pawl 202, the detent roll 226 engaging in the next detent notch 216*b*, and the white area 220'' showing through the indicator window 248. As previously described, after the container 174 has been fully inserted in the cradle, the handle 268 is rotated to a downwardly, extending position so as to rotate the door 178 to its open position and hold the container in position in the cradle. While the ATM is in operation, currency-containing envelopes deposited by customers in the ATM are fed through the open door 178 into the receptacle 176 where they are securely held until such time as the seal on the door (not shown) of the receptacle is broken and this last-mentioned door is opened.

For all the time that the door 178 is open for receipt of envelopes, the container 174 is securely held in the cradle by means of the handle 268. It should be understood that the cradle is so constructed that with the container 174 mounted therein, access to the contents of the receptacle 176 via the open door 178 is impossible. When it is desired to remove from the container 174 any envelopes held in the receptacle 176, the container is normally first removed from the ATM by rotating the handle 268 to its horizontal position and withdrawing the container from the cradle. During the withdrawal of the container 174 the slide members 186 and 188 are moved out of engagement with the key pins 258 and are returned to their forwardmost positions under the action of the springs 196, in which positions the slide members 186 and 188 lock the door 178 in its closed position by virtue of the projections 252 engaging the lower ends of the lugs 256. Thus, the door 178 is locked prior to the container 174 being removed from the ATM.

As in the case of the container 10, the container 174 is normally taken to a secure or authorized area for the container 174 to be opened. Before the door of the receptacle 176 is opened, a check is made to ascertain that the seal has not been broken, that the door 178 is in its fully closed position, and that the marking showing through the indicator window 248 is noted. If the white area 220'' shows through the window 248, this indicates that only a single insertion of the container 174 into an ATM has been made since the container was sealed and that no unauthorized unlocking of the door 178 has taken place. The seal can then be broken, the door of the receptacle 176 opened, and the contents of the container 174 removed from the receptacle 176. If one of the numerals 2 to 6 on a red background shows through the indicator window 248, this indicates that the door 178 has been unlocked more than once since the container was sealed, the number of times the container has been unlocked corresponding to the numeral showing through the window 248. Again as in the case of the container 10, if a numeral on a red background shows through the indicator window, this can mean that the container 174 has been inserted more than once into the ATM or has been tampered with following removal from the ATM and an explanation will be required.

An explanation will also be required if the door 178 is held out of its fully closed position due to one or each of the slide member projections 252 being trapped in the recess 257 (FIG. 11) of the respective lug 256, since this also could indicate that tampering with the container 174 has taken place following its removal from the ATM. Thus, if an unauthorized attempt has been made to open the door 178 by disengaging the projections 252 from the lugs 256 using elongated implements inserted through the slots for the key pins 258 in the wall 262 and then pivoting the door 178 towards its open position, then there is a good possibility that one or each of the projections 252 will be urged by the associated spring 196 into the respective recess 257 during such pivotal movement of the door 178. Once a slide member 186, 188 has been trapped in this way, it is virtually impossible to free it using an implement inserted through the relevant key pin slot since access to the respective lug 256 is barred by the associated lug 255 disposed in front of the lug 256.

It will be appreciated that the container 174 has the capability of being inserted up to six times into an ATM without the necessity of returning the container to the secure area for unsealing of the door of the receptacle 176. Following the sixth insertion the numeral 6 shows through the window 248, and the container 174 is locked against a further insertion into the ATM due to the lug 232 on the detent lever 222 being in engagement with the recess 250 in the slide member 186. It will then be necessary to return the container 174 to the secure area for unsealing of the door of the receptacle 176 and releasing the slide member 186 by pulling downwardly on the lower portion 240 of the actuating arm 234. It will be appreciated that the locking of the container 174 against a further insertion as just described protects the counter slide 208 against possible impact damage while the latter is locked against movement due to the detent roll 226 being in engagement with the deep detent notch 218.

If desired, the number of possible insertions of the container 174 into an ATM can be restricted to a number less than six. This is done by initially setting the counter slide 208 to a position in which the detent roll 226 is in engagement with one of the detent notches 216*a*–216*f* other than the notch 216*a*; this setting is achieved by moving the portion 240 of the actuating arm 234 from right to left with reference to FIG. 10 so as to pivot the arm 234 in a clockwise direction and cause its upper finger 244 to engage the stud 246 on the slide 186, thereby moving the slide member 186 rearwardly and moving the counter slide 208 to the required position under the action of the pawl 202. If, for example, the counter slide 208 is initially set to a position in which the roll 226 is in engagement with the notch 216*c* (corresponding to the numeral 2 showing through the window 248), then up to four insertions of the container 174 in the ATM will be permitted.

Each of the containers 10 and 174 described above has the advantage that its tamper-indicating features make it feasible for the transportation of the container from an ATM to a remote secure area to be entrusted to a third party such as a security firm. Also, the containers each have the additional advantage that the multiple-insertion facility obviates the need for resetting of the tamper-indicating means each time the container is removed from the ATM with which it is being used, thereby reducing the time for which the ATM is out of operation. A further advantage of the containers described above is that they have a flexible insertion capability in that they can be preset to permit from only one up to six insertions in the associated ATM. In this connection it will be appreciated that the indicator wheel 78 or counter slide 208 provides an indication of the insertion capability to which each container has been set.

What is claimed is:

1. A container for articles, comprising:

locking means arranged to permit the deposit of said articles in said container when in an unlocked condition and to prevent deposit of said articles in said container when in a locked condition; and resettable indicator means for indicating the number of times said locking means has been unlocked after a resetting of said indicator means;

said resettable indicator means comprising an indicator member arranged to be sequentially moved from one to another of a predetermined number of possible positions each time an unlocking and locking cycle of operation of said locking means takes place; and said container further comprising a container opening means, separate from said locking means, for gaining access to the interior of the container for the purpose of removing said articles held in the container and for resetting said indicator member to an initial position.

2. The container as claimed in claim 1, wherein said container has a wall having an opening therein and wherein said indicator member carries a series of markings thereon; the positioning of said indicator member in a particular one of said possible positions causing a respective one of said markings to be visible through said opening.

3. The container as claimed in claim 2 in which said container further comprises:

detent means arranged to lock said indicator member against further sequential movement in consequence of said indicator member reaching a predetermined position; and actuating means for moving said detent means out of locking engagement with said indicator means, with access to said actuating means being obtainable only in consequence of gaining access to said interior of said container.

4. The container as claimed in claim 3, wherein said container further comprises resetting means for resetting said indicator member to a selected one of a number of possible initial positions other than said predetermined position, whereby following such resetting said locking means has the capability of being unlocked a selected number of times dependent on the initial setting of said indicator member.

5. The container as claimed in claim 4 wherein said container further comprises:

blocking means movable between an unblocking position and a blocking position in which it blocks the unlocking of said locking means, said blocking means being arranged to be moved into said blocking position in consequence of said indicator member reaching said predetermined position; and holding means for holding said blocking member in said unblocking position while said indicator member is in a position other than said predetermined position.

6. The container as claimed in claim 5, wherein said actuating means is operable to restore said blocking means from its blocking position to its unblocking position.

7. The container as claimed in claim 6 wherein said container further comprises slide means adapted to be moved from a first position to a second position for the purpose of setting said locking means to its unlocked condition and from said second position to said first position for the purpose of setting said locking means to its locked position, said slide means being arranged to cooperate with said indicator means in such a manner that a cycle of movement of said slide means from said first position to said second position and back to said first position causes a single sequential movement of said indicator member from one position to another.

8. The container as claimed in claim 7 wherein said container further comprises ratchet means arranged to bring about a single sequential movement of said indicator member in response to a said cycle of movement of said slide means.

9. An apparatus comprising:

a container for valuable articles; said container comprising:

locking means arranged to permit the deposit of said articles in said container when in an unlocked condition and to prevent deposit of said articles in said container when in a locked condition; and resettable indicator means for indicating the number of times said locking means has been unlocked after a resetting of said indicator means;

said resettable indicator means comprising an indicator member arranged to be sequentially moved from one to another of a predetermined number of possible positions each time an unlocking and locking cycle of operation of said locking means takes place; and said container further comprising a container opening means, separate from said locking means, for gaining access to the interior of the container for the purpose of removing said articles held in the container and for resetting said indicator member to an initial position;

said container having a wall having a window therein; said indicator member carrying a series of markings thereon; the positioning of said indicator member in a particular one of said possible positions causing a respective one of said markings to be visible through said window;

detent means arranged to lock said indicator member against further sequential movement in consequence of said indicator member reaching a predetermined position;

actuating means for moving said detent means out of locking engagement with said indicator means, with access to said actuating means being obtainable only in consequence of gaining access to said interior of said container;

resetting means for resetting said indicator member to a selected one of a number of possible initial positions other than said predetermined position, whereby following such resetting said locking means has the capability of being unlocked a selected number of times dependent on the initial setting of said indicator member;

blocking means movable between an unblocking position and a blocking position in which said blocking means blocks the unlocking of said locking means, said blocking means being arranged to be moved into said blocking position in consequence of said indicator member reaching said predetermined position; and holding means for holding said blocking member in said unblocking position while said indicator member is in a position other than said predetermined position;

said actuating means being operable to restore said blocking means from its blocking position to its unblocking position;

slide means adapted to be moved from a first position to a second position for the purpose of setting said locking means to its unlocked condition and from said second position to said first position for the purpose of setting said locking means to its locked position, said slide means being arranged to cooperate with said indicator means in such a manner that a cycle of movement of said slide means from said first position to said second position and back to said first position causes a single sequential movement of said indicator member from one position to another; and ratchet means arranged to bring about a single sequential movement of said indicator member in response to a said cycle of movement of said slide means;

said apparatus also comprising receiving means, with said container being adapted to be inserted into said receiving means of said apparatus from which said valuable articles can be deposited into said container, said receiving means incorporating key means adapted to engage said slide means, wherein said wall of said container has formed therein aperture means aligned with said slide means, whereby during insertion of the container into said receiving means said key means pass through said aperture means and engage said slide means for the purpose of moving said slide means from said first position to said second position.

10. The apparatus as claimed in claim 9 in which said apparatus further comprises retaining means arranged to be moved to a key engaging position during movement of said slide means to said second position in response to engagement by said key means, said retaining means, when in said key engaging position, serving to hold the container in said receiving means by virtue of the engagement of said key means by said retaining means.

11. The apparatus as claimed in claim 10 in which said apparatus further comprises means adapted to engage said slide means for the purpose of trapping said locking means in a partially open position in response to movement of said slide means away from and towards said first position brought about by means other than said key means.

12. The apparatus as claimed in claim 11 wherein said container is adapted to be inserted in a said receiving means incorporating first and second key members, and wherein said slide means comprises first and second slide members arranged to be engaged by said first and second key members respectively, only one of said slide members being arranged to cooperate with said indicator means.

13. The apparatus as claimed in claim 12 wherein said apparatus further comprises means for providing an indication of when said container is fully inserted in said receiving means.

14. The apparatus as claimed in claim 13 in which said resettable indicator means is in the form of an indicator wheel.

15. The apparatus as claimed in claim 13 in which said resettable indicator means is in the form of an indicator slide.

* * * * *